US005229816A

United States Patent [19]

Fujimoto et al.

[11] Patent Number: 5,229,816

[45] Date of Patent: Jul. 20, 1993

[54] ORIGINAL IMAGE READING DEVICE

[75] Inventors: Hitoshi Fujimoto; Masataka Naitou; Katsuaki Hirai, all of Kawasaki, Japan

[73] Assignee: Canon Kabushiki Kaisha, Tokyo, Japan

[21] Appl. No.: 665,909

[22] Filed: Mar. 7, 1991

[30] Foreign Application Priority Data

Mar. 13, 1990 [JP] Japan ..... 2-62318

[51] Int. Cl.[5] ..... G03G 21/00

[52] U.S. Cl. ..... 355/208; 355/317; 355/320; 355/321; 271/3.1; 271/186; 271/301; 271/902

[58] Field of Search ..... 355/317, 318, 320, 321, 355/68, 203, 208; 271/3.1, 185, 186, 291, 301, 902

[56] References Cited

U.S. PATENT DOCUMENTS 4,544,148 10/1985 Kitajima et al. ..... 271/3.1
4,662,738 5/1987 Kasuya ..... 355/208
4,733,306 3/1988 Matsunawa et al. ..... 358/280
4,761,001 8/1988 Hayakawa et al. ..... 271/3.1
4,812,881 3/1989 Kumamoto et al. ..... 355/77
4,935,775 6/1990 Ueda et al. ..... 355/202
4,975,749 4/1990 Tsunoda et al. ..... 355/320

*Primary Examiner*—Michael L. Gellner
*Assistant Examiner*—P. J. Stanzione
*Attorney, Agent, or Firm*—Fitzpatrick, Cella, Harper & Scinto

[57] ABSTRACT

An original image reading device includes an original mount, a feeder for separating and feeding originals on the original mount, a first feed path for guiding each separated and fed original to a reading position, and an inlet for introducing the original discharged from the reading position. A second feed path having a joining portion to join the first feed path guides the original introduced from the inlet to the joining portion while reversing the surface of the original. An original density detection sensor is provided between the joining portion and the reading position in the first feed path.

17 Claims, 9 Drawing Sheets

ORIGINAL IMAGE READING DEVICE

BACKGROUND OF THE INVENTION

1. Field of the Invention

This invention relates to an original image reading device, and more particularly, to an original image reading device which includes means for detecting the density of a sheet fed by an automatic sheet feeder.

2. Description of the Related Art

Heretofore, in performing automatic density adjustment when copying a sheet using an automatic sheet feeder, the density of the sheet has been detected by density detection means provided within the main body of an image forming apparatus, and a signal representing the density has been transmitted to the main body of the image forming apparatus to perform automatic density adjustment.

In the above-described prior art, however, since density detection is performed after mounting the sheet on a platen glass of the image forming apparatus using the automatic sheet feeder and density adjustment is performed after receiving the detection signal, a considerable amount of time is needed before starting a copying operation. As a result, the prior art has the problem that the number of sheets which can be copied within a unit time by the image forming apparatus is reduced.

A plurality of sheet feed paths are present in the automatic sheet feeder, such as a path to feed the sheet to a predetermined position in the image forming apparatus, a path to reverse the sheet, a feed path for manually providing a sheet in an interrupt operation, and the like. If density detection means are provided at the plurality of paths, additional time is needed for adjusting the density levels of the respective detection means with one another, and problems might occur as a result of insufficient adjustment. Furthermore, the prior art, for example, might have the problems that the size of the apparatus becomes large as a result of providing a large number of detection means, and the production cost is thereby increased.

SUMMARY OF THE INVENTION

The present invention has been made in consideration of the above-described problems in the prior art.

It is an object of the present invention to provide an original image reading device which can perform high-speed reading, and which can be made in a small size.

It is another object of the present invention to make it possible to read two images of an original having images on both surfaces in the same condition.

According to one aspect, the present invention relates to a reading device comprising an original mount, a first path for guiding an original to a reading position, a sheet feed path for joining the first path, and a feed means for feeding the original to the reading position. A density detection means detects the density of the original being fed and is provided at a joining position or a position near a side downstream from the joining portion of the first path and the sheet feed path.

According to the present invention, since the density of the original being fed is detected at a position near a side downstream from the most downstream joining portion of the first path and other plurality of sheet feed paths, the density of all the originals being fed can be detected by a single density detection means. Hence, the space required to install density detection means can be reduced. As a result, it is possible to prevent the device from having a large size, and to reduce the production cost of such a device.

Furthermore, since the density data of the original can be obtained before the original is fed to the reading position, scanning of the original can be immediately performed according to the density data. Hence, it is possible to shorten the time needed for a reading operation, and to improve the capacity of the device.

DESCRIPTION OF THE PREFERRED EMBODIMENTS

Embodiments of the present invention will now be explained with reference to the drawings.

Figure 1:
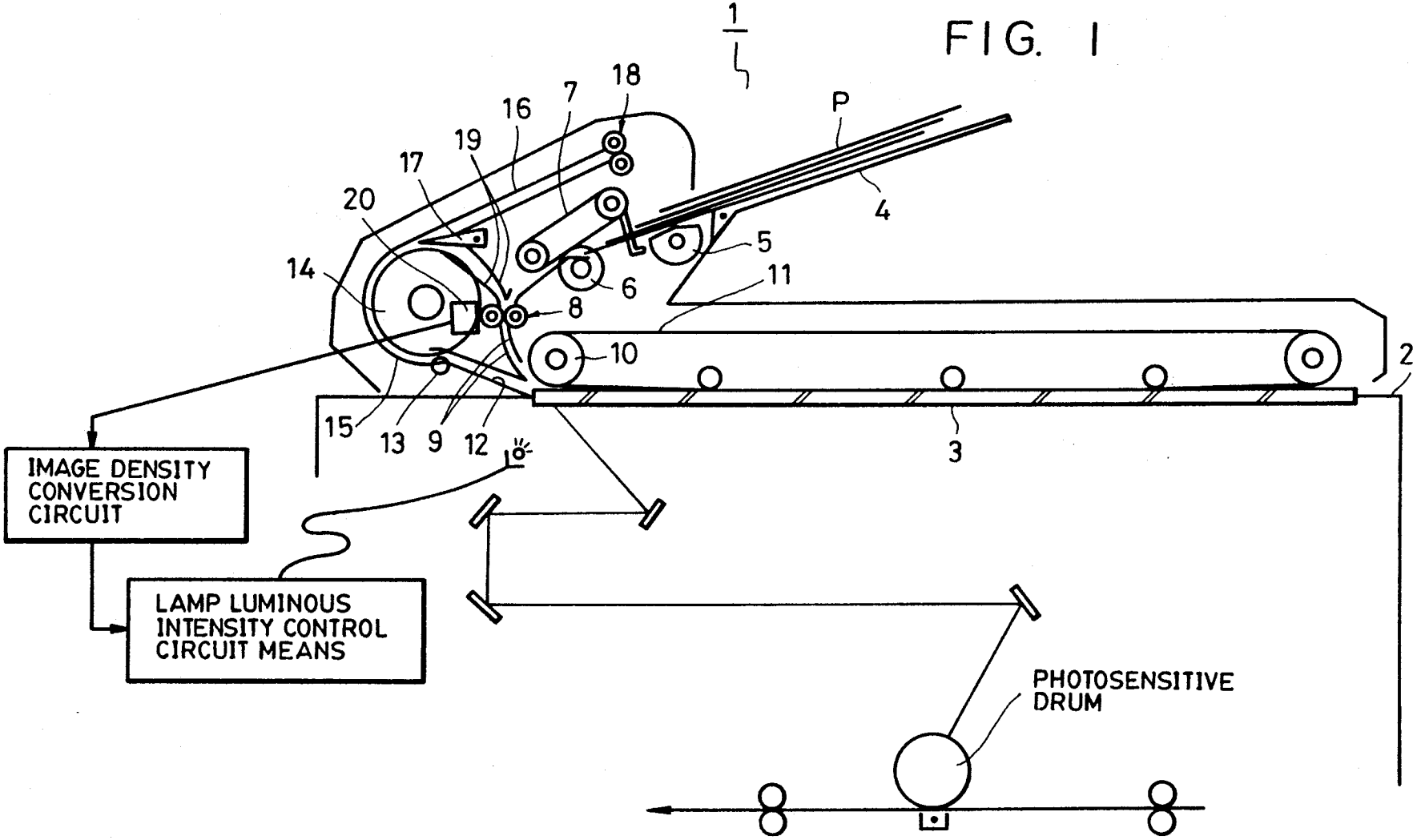
FIG. 1 is a cross-sectional side view of an original reading device according to the present invention.

FIG. 1 shows an original reading device 1 which is mounted on an image forming apparatus (for example, U.S. Pat. No. 4,761,001) comprising a copier 2, and which includes an automatic sheet feeder for cyclically feeding originals (sheets) P to a platen 3 of the copier 2.

In FIG. 1, a mounting tray 4 mounts the sheets P, which are fed by a semicircular feed roller 5. The sheets P are then individually separated and fed by a separation roller 6 and a separation belt 7. The sheets P are mounted on the mounting tray 4 with their faces up in the order of pages 1, 2, 3, etc. from above.

If the sheet P is fed when registration rollers 8 stop, the leading end of the sheet P is hindered by nip portions of the registration rollers 8 to form a deflection, and the oblique movement of the sheet P is regulated. The sheet P having the deflection is guided through guides 9 by the rotation of the registration rollers 8, and is fed to an end surface of the platen 3. The sheet P is then fed on the platen 3 to an image scanning region corresponding to the size of the sheet P by a feed belt 11 driven by rollers 10, and is stopped.

After the sheet P has been read (copied), the rollers 10 rotate in the reverse direction. The sheet P is thereby fed on a guide 15 via a guide 12 by a backup roller 13 and reversely rotating roller 14. Subsequently, the sheet P passes through a guide 16 when a flapper 17 is downwardly positioned to be open in the direction of the guide 16, and is discharged onto the mounting tray 4 by discharge rollers 18.

When copying the two surfaces (the back surface) of the sheet P, the sheet P is moved in the same manner as described above until it passes through the platen 3, the guide 12 and the guide 15. Subsequently, the flapper 17 is upwardly positioned to obturate the guide 16. Thus, the sheet P passes through guides 19, then through the registration rollers 8 and the guides 9 in the same manner as described above, and is copied (read) on the platen 3. Subsequently, the sheet P passes through the guide 12, the guide 15 and the guide 16 with the flapper 17 downwardly positioned, and is discharged onto the mounting tray 4 by the discharge rollers 18.

In the above-described automatic sheet feeder 1, an automatic density detection sensor 20 is provided at the left near a downstream side of the registration rollers 8.

Figure 2:
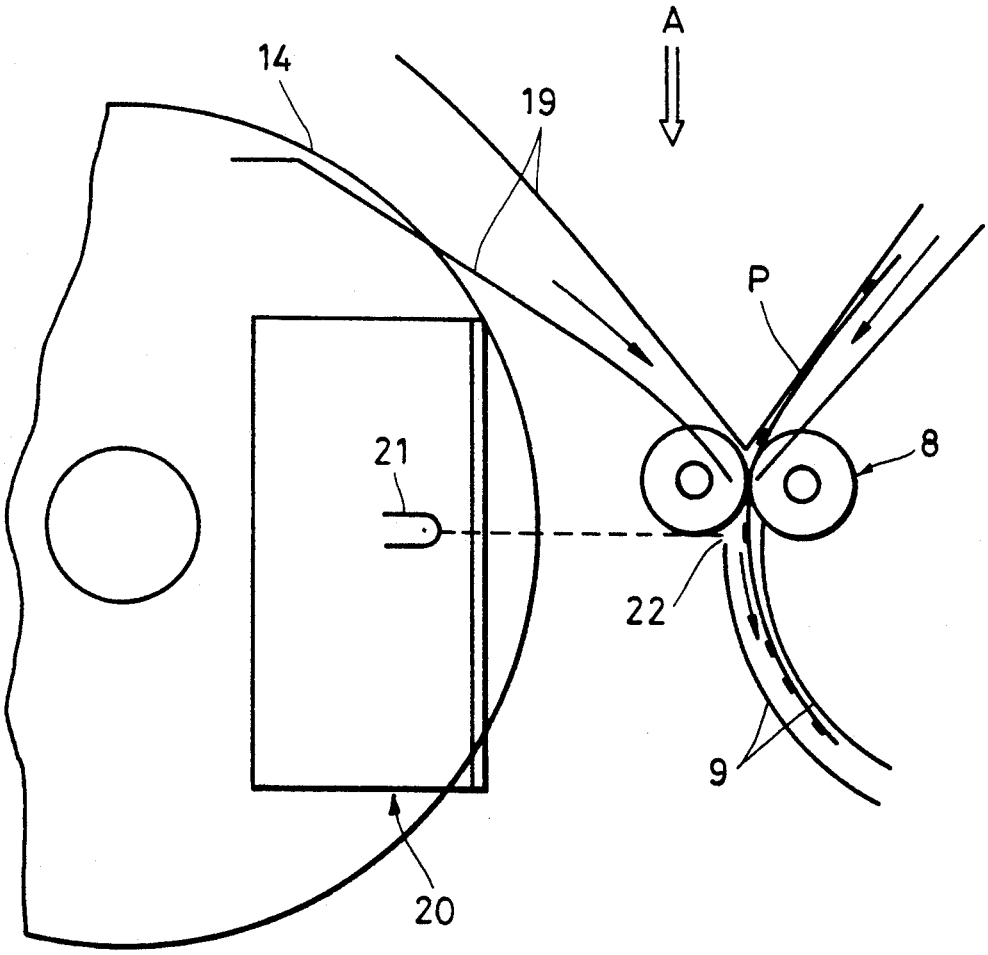
FIG. 2 is an enlarged cross-sectional side view of a density detection unit.
Figure 4:
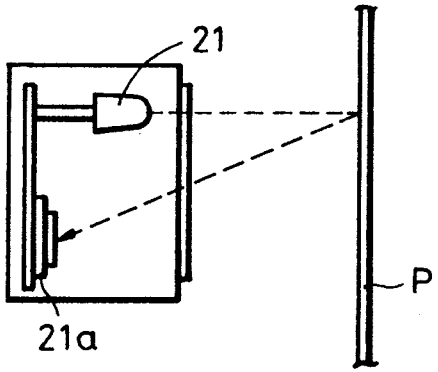
FIG. 4 shows the FIG. 2 unit, as seen from direction A.

The automatic density detection sensor 20 will be explained in detail with reference to FIG. 2. The sensor 20 is mounted between the reversely rotating roller 14, composed of a plurality of rollers mounted on a single shaft. A lamp 21 and a photosensor 21*a* (see FIG. 4) are provided in the sensor 20. A hole 22 is provided in the guide 9 near the downstream side of the registration rollers 8 (see FIG. 2). Light from the lamp 21 passing through the hole 22 is reflected by the sheet P being fed. When the light reflected by the sheet P is incident upon the photosensor 21*a*, the image density on the sheet P is converted into an electric signal by the photosensor 21*a*, and the luminous intensity of a scanning lamp L of the copier 2 is controlled by the electric signal.

Next, the function of the present embodiment will be explained.

Figure 5:
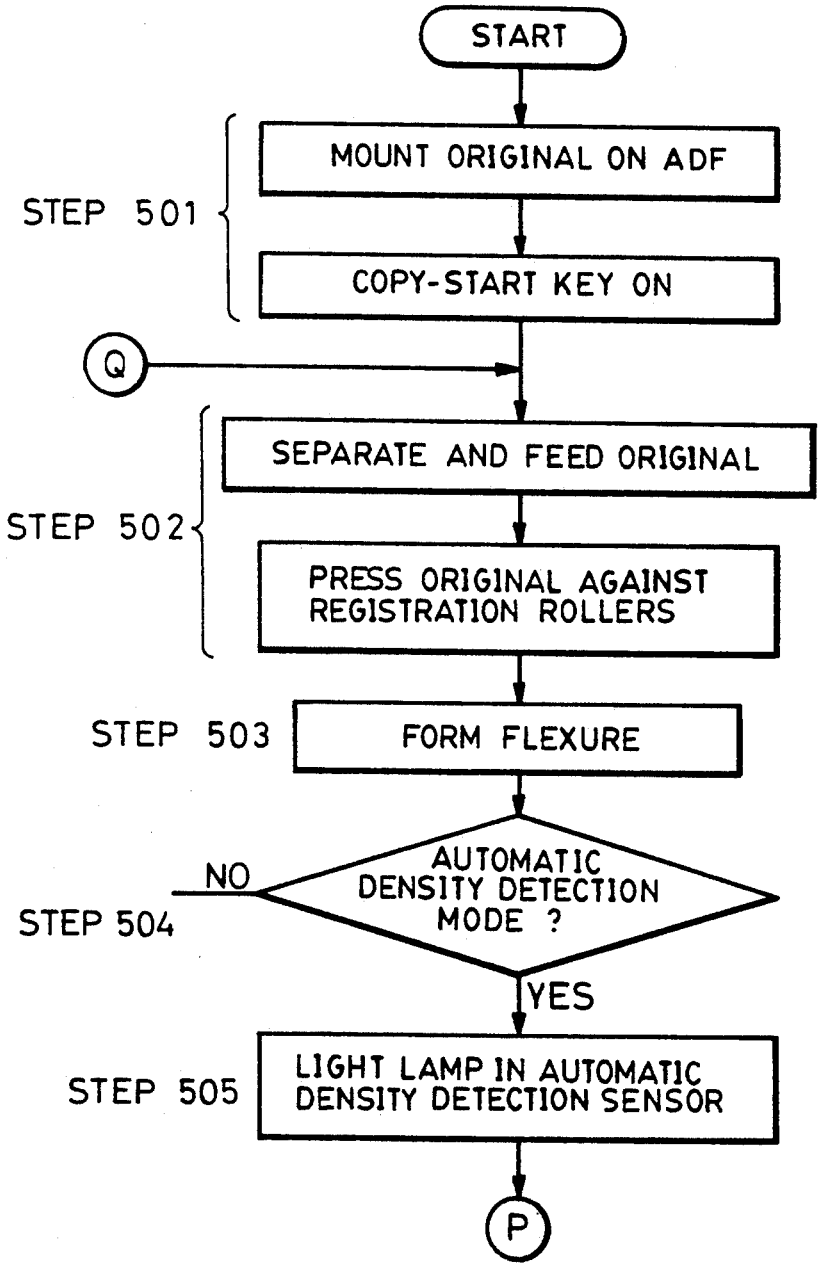
FIGS. 5(*a*) and 5(*b*) are flowcharts of the operation sequence of the original reading device.
Figure 5B:
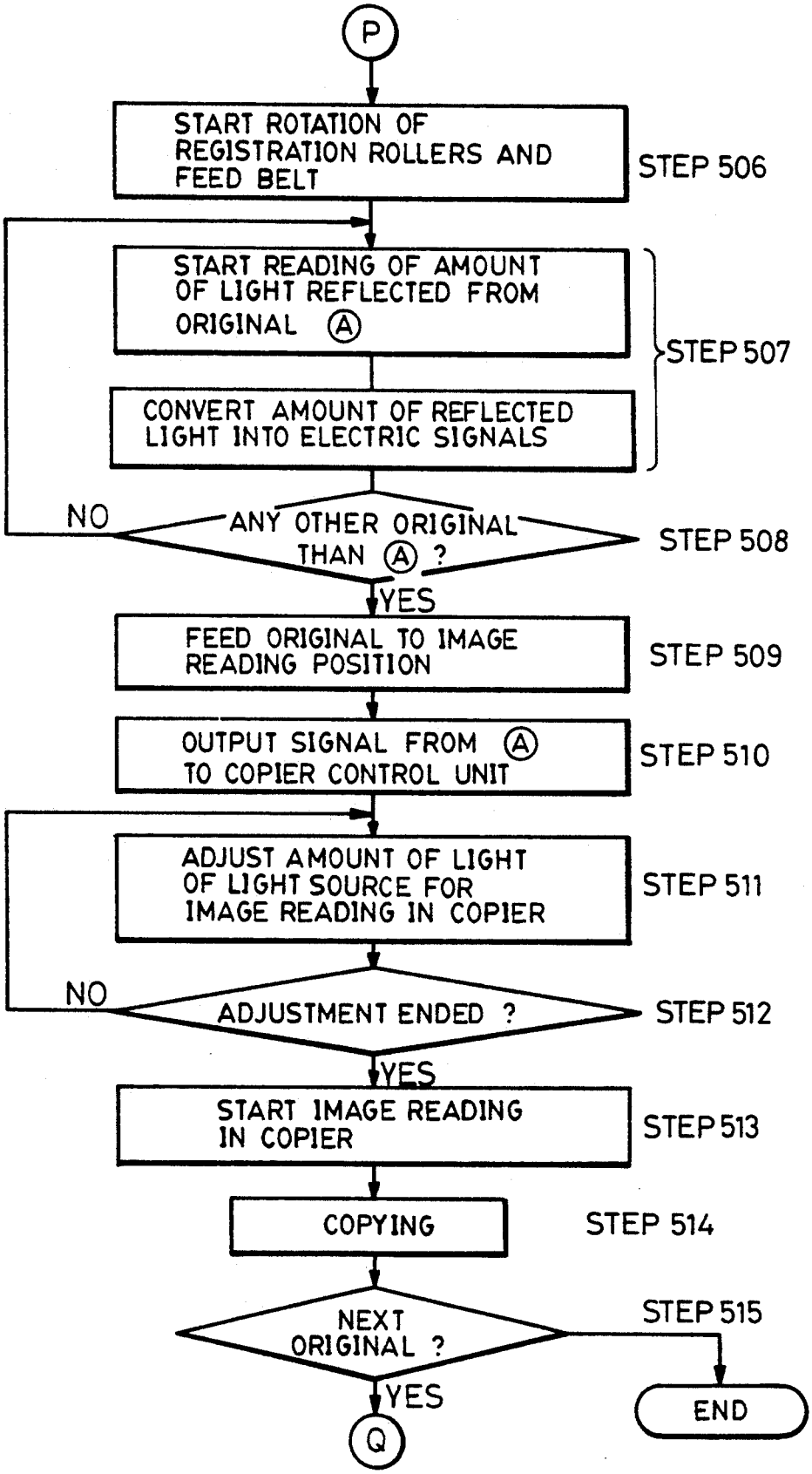

When the sheet P situated at the lowest position in the bundle of sheets on the mounting tray 4 has been fed by the feed roller 5 (see FIG. 5, step 501), has been separated by the separation roller 6 and the separation belt 7, and has been fed to the registration rollers 8 (step 502), the leading end of the sheet P is hindered by the registration rollers 8 to form a deflection (step 503), and the oblique movement of the sheet P is thereby regulated. It is determined whether or not the apparatus is in an automatic density detection mode (step 504). If the result of determination is affirmative, the lamp 21 of the automatic density detection sensor 20 is lit(step 505).

Subsequently, in accordance with a copy signal, the registration rollers 8 and the feed belt 11 start to rotate in synchronization with each other (step 506). At this time, if the density of an image on the sheet P has been detected by the automatic density detection sensor 20 (step 507), while determining whether or not the entire length of the sheet P has passed (step 507), the detection sensor 20 transmits a signal representing the density to a control unit of the copier 2 to adjust the luminous intensity of the lamp for scanning the sheet P.

The sheet P fed by the registration rollers 8 and the belt 11 is moved to an image scanning region on the platen 3, and is stopped (step 509).

At this time, since the luminous intensity of the lamp for scanning the sheet P of the copier 2 has already been adjusted (steps 511 and 512), the scanning of the sheet P by the copier 2 is immediately performed (step 513). Subsequently, the image is copied (step 514), and it is determined whether or not the next sheet is present (step 515). If the result of detemination is affirmative, the process proceeds to step 502. If the result of determination is negative, the process is terminated.

When copying two surfaces of the sheet P, the density of the back surface of the sheet P is detected by the automatic density detection sensor 20 in the manner as described above while the sheet P is fed from the position on the platen 3 through the guides 12, 15 and 19 by the registration rollers 8. A detection signal is transmitted from the detection sensor 20 to the control unit of the copier 2 to adjust the luminous intensity of the lamp for scanning the back surface of the sheet P.

The sheet P is fed by the registration rollers 8 and the belt 11 with its back surface down, is moved to the image scanning region on the platen 3 in the same manner as described above, and is stopped.

As explained above, since the luminous intensity of the scanning lamp of the copier 2 has already been adjusted when the sheet P stops at the image scanning region on the platen 3, the sheet P can be immediately copied by the copier 2 (step 514). Hence, copy speed by the copier 2 can be largely increased.

In the present embodiment, for the sheet P entering from two paths when the sheet P enters the registration rollers 8 via the guide 19 and when the sheet P enters the registration rollers 8 by the feed roller 5 and the separation roller 6, the single automatic density detection sensor 20 is provided at a position near a downstream side of the registration rollers 8 (that is, near a downstream side of the joining point of the two paths), and the density of the sheet P passing through the two paths can be detected by the single detection sensor 20. Hence, it is possible to omit troublesome adjustment of the detection levels of detection sensors which must be performed when a plurality of detection sensors are provided before the joining point, thus reducing the installation space.

The effect of the present invention becomes more pronounced for a device which includes an interrupt path or the like.

In order to extend the life of the lamp 21 of the automatic density detection sensor 20, the lamp 21 may be lit until all the sheets P in copying have been copied, rather than lighting on and off the lamp 21 for every sheet P.

When circulating the sheet P a plurality of times, detection information at the first circulation may be stored, and density adjustment may be performed according to the information obtained at the first circulation for operations after the second circulation.

Detection information obtained from a plurality of sheets P may be stored at the first mode. When the mode is switched, density detection may be performed only for the first sheet P to the known mode, and density detection may not be performed for the other sheets.

The sensor 20 may be disposed at a side upstream from the registration rollers 8. Furthermore, the sensor 20 may be disposed at a joining portion.

Figure 3:
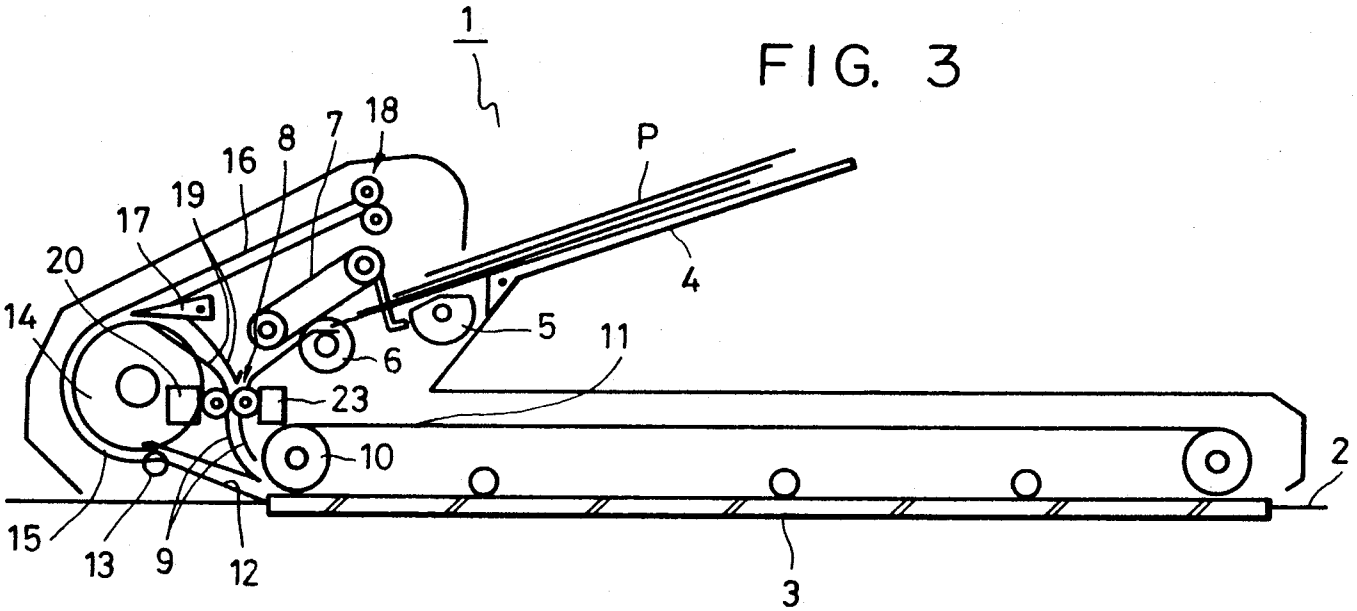
FIG. 3 is a cross-sectional side view of another embodiment of the present invention.

An explanation will now be provided of another embodiment of the present invention with reference to FIG. 3.

In the present embodiment, an automatic density detection sensor 23 is provided at the right of the guides 9 so as to face the above-described automatic density detection sensor 20.

According to such a configuration, in a copying operation in a duplex mode, when the sheet P passes from the mounting tray 4 via the feed roller 5, the separation roller 6 and the belt 7 through the registration rollers 8, the sensor 20 detects the density of an image on the surface of the sheet P, and at the same time the sensor 23 can detect the density of an image on the back surface of the sheet P.

While a signal from the sensor 20 functions in the same manner as in the foregoing embodiment, a signal from the sensor 23 is stored in a memory. When performing subsequent surface-to-back reversal copying of the sheet P, the luminous intensity of the scanning lamp of the copier 2 is adjusted in accordance with the data stored in the memory.

Thus, in a reversal copying operation of the sheet P, density detection of the back surface of the sheet P may be omitted. Hence, it is possible to shorten the copying time.

Next, the embodiments of the present invention will be explained in detail with reference to FIGS. 6 through 9.

Figure 6:
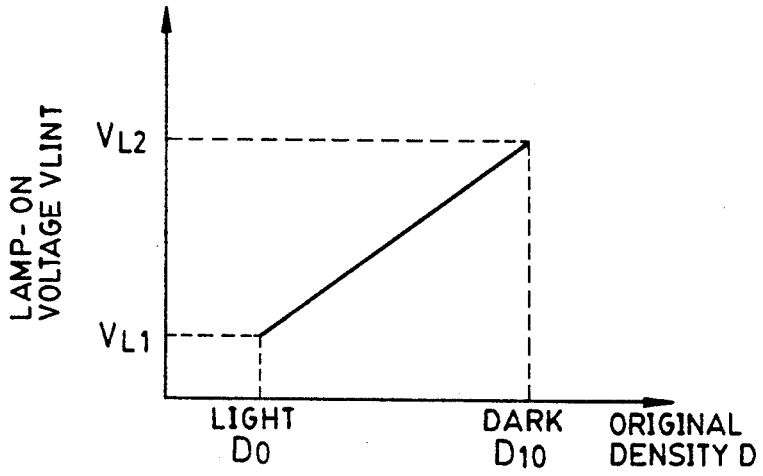
FIG. 6 is a graph showing the ON voltage of an original illumination lamp as a function of original density D.

FIG. 6 shows an ON voltage signal VLINT of the original illumination lamp as a function of the original density D. It is seen that the ON voltage VLINT changes within a range of a lamp ON voltage VL1 corresponding to a light original and a lamp ON voltage VL2 corresponding to a dark original.

Figure 7:
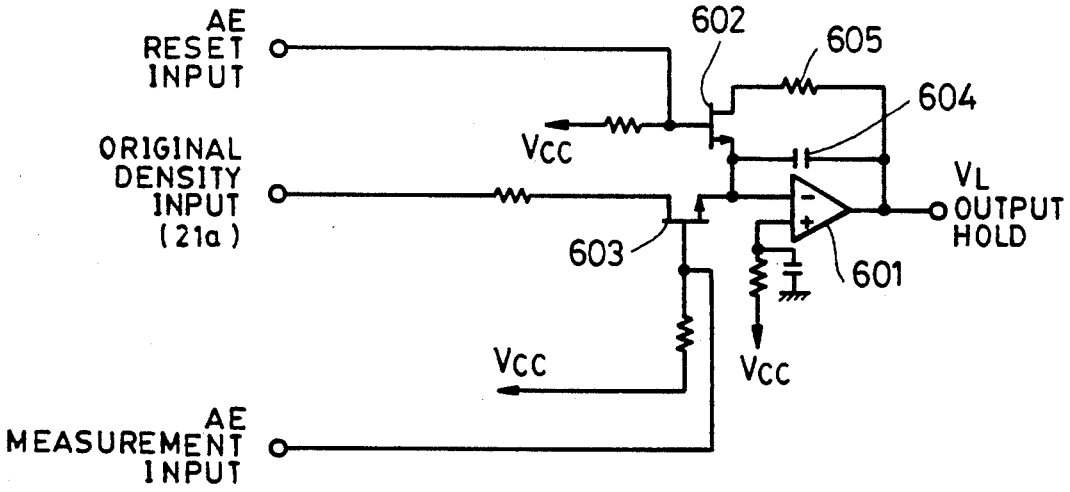
FIG. 7 is a circuit diagram of an AE (automatic exposure) measurement circuit.

FIG. 7 shows a circuit diagram of an automatic exposure (AE) measurement circuit 704.

Referring to FIG. 7, the AE measurement circuit has an operational amplifier 601, a peak hold capacitor 604, switching gate FETs 602 and 603 for resetting and holding, and a resistor 605 for discharging the capacitor 604.

When the original density signal supplied to the gate FET 603 reaches a predetermined level, the gate of the holding gate FET 603 is opened to hold the peak value of the original density.

Since the peak value of the original density held in this manner must be reset in the next measurement cycle, the AE reset signal is supplied to open the resetting gate FET 602, thereby discharging the charge on the holding capacitor 604.

Figure 8:
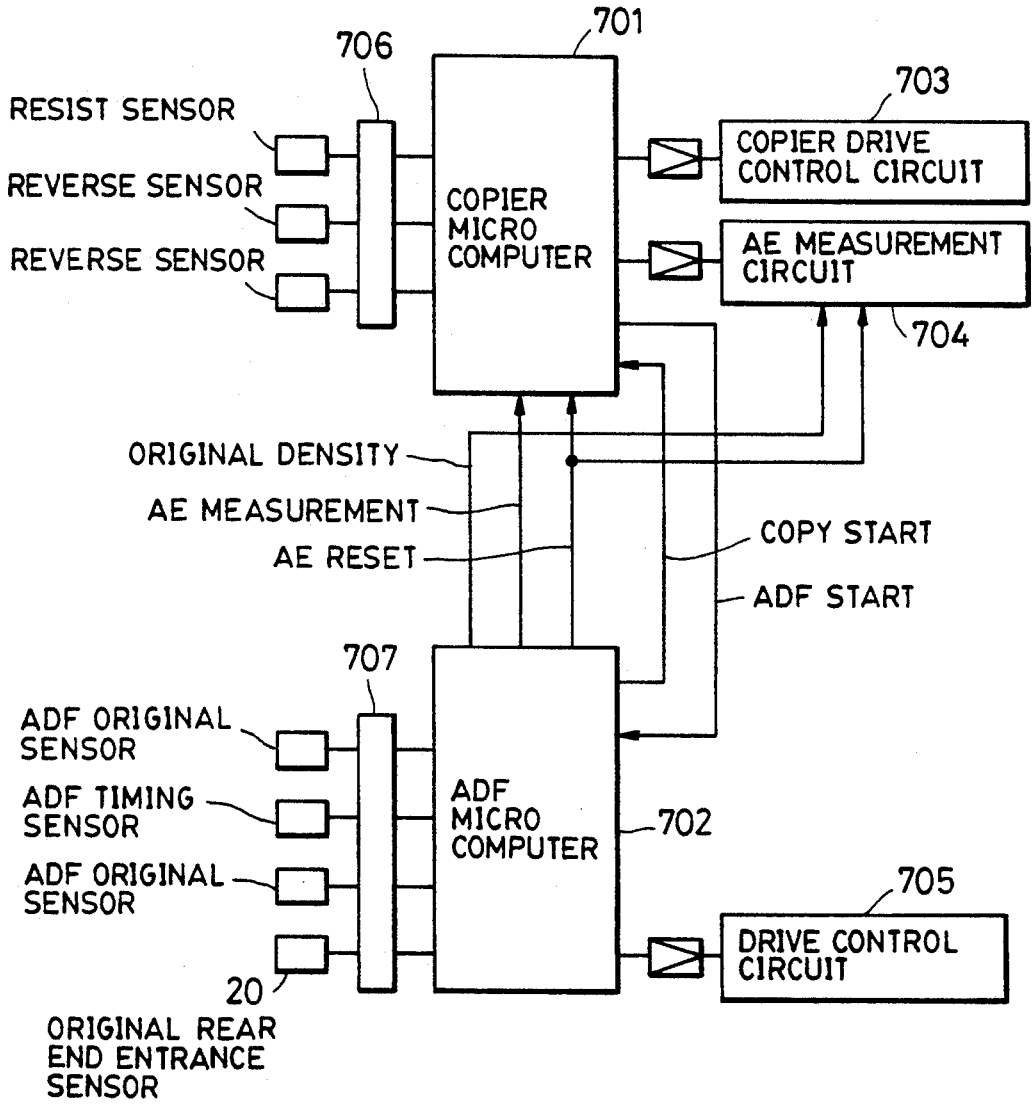
FIG. 8 is a block diagram showing a CPU (central processing unit) for performing the copying sequence and the ADF (automatic document feeder) operation.

FIG. 8 is a block diagram of a control section for controlling the copying machine and the ADF (automatic document feeder). A microcomputer 701 controls the copying sequence, a microcomputer 702 controls the ADF operation, a control circuit 703 controls the driving operation of the motor and the like of the copying machine, and AE measurement circuit 704 measures the AE, and ADF drive control circuit 705 controls the motor and the like of the ADF. Interfaces 706 and 707 serve as interfaces between the respective sensors and the microcomputers. The copying sequence of the copying machine and the operation of the ADF will be described with reference to the flowchart of the ADF shown in FIGS. 9A and 9B. The following description will be made for the operation of the ADF and the subsequent copying sequence of the copying machine with reference to a case wherein a single original is to be copied using the ADF.

Figure 9A:
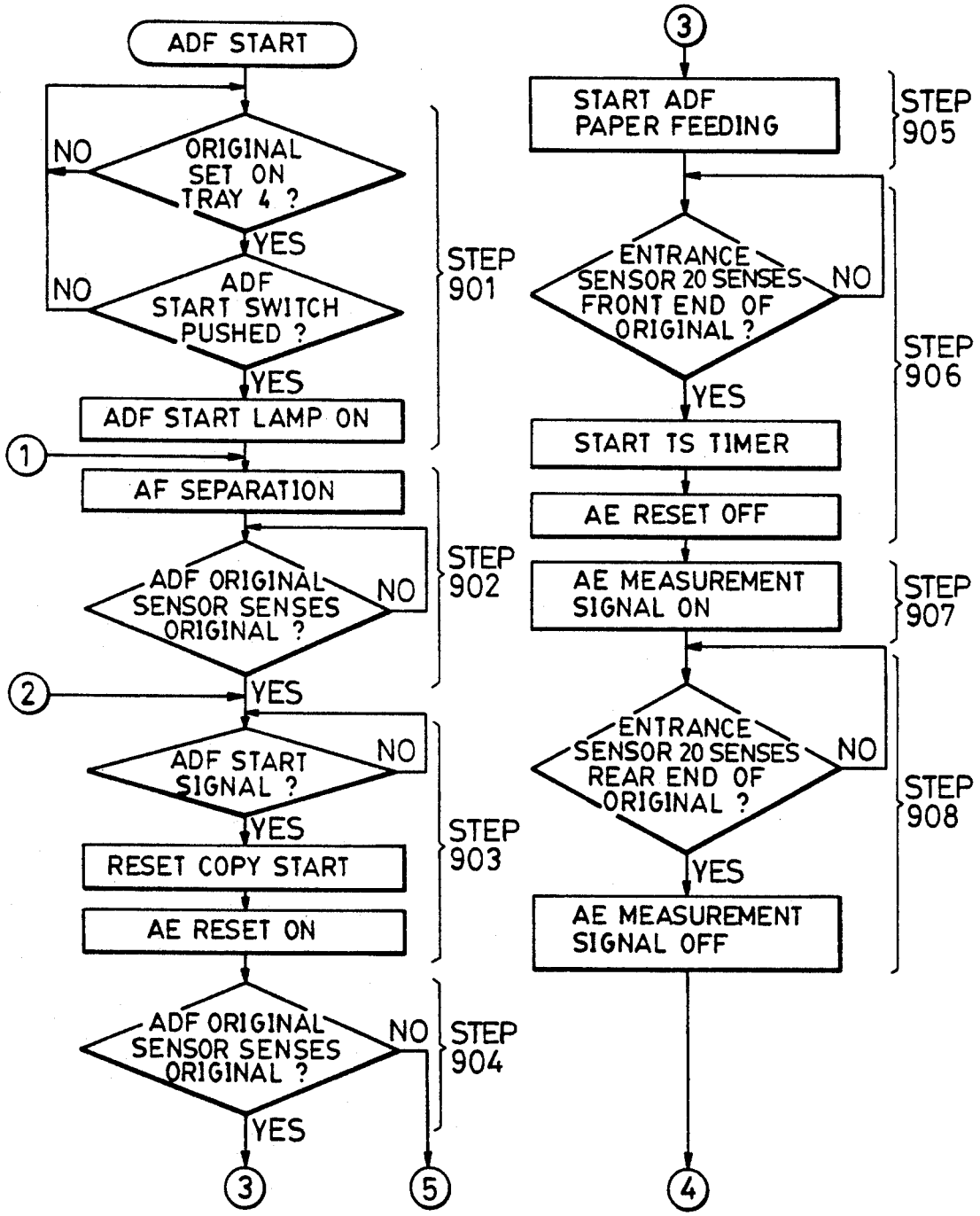
FIGS. 9A and 9B are flowcharts of the operation sequence of the ADF.
Figure 9B:
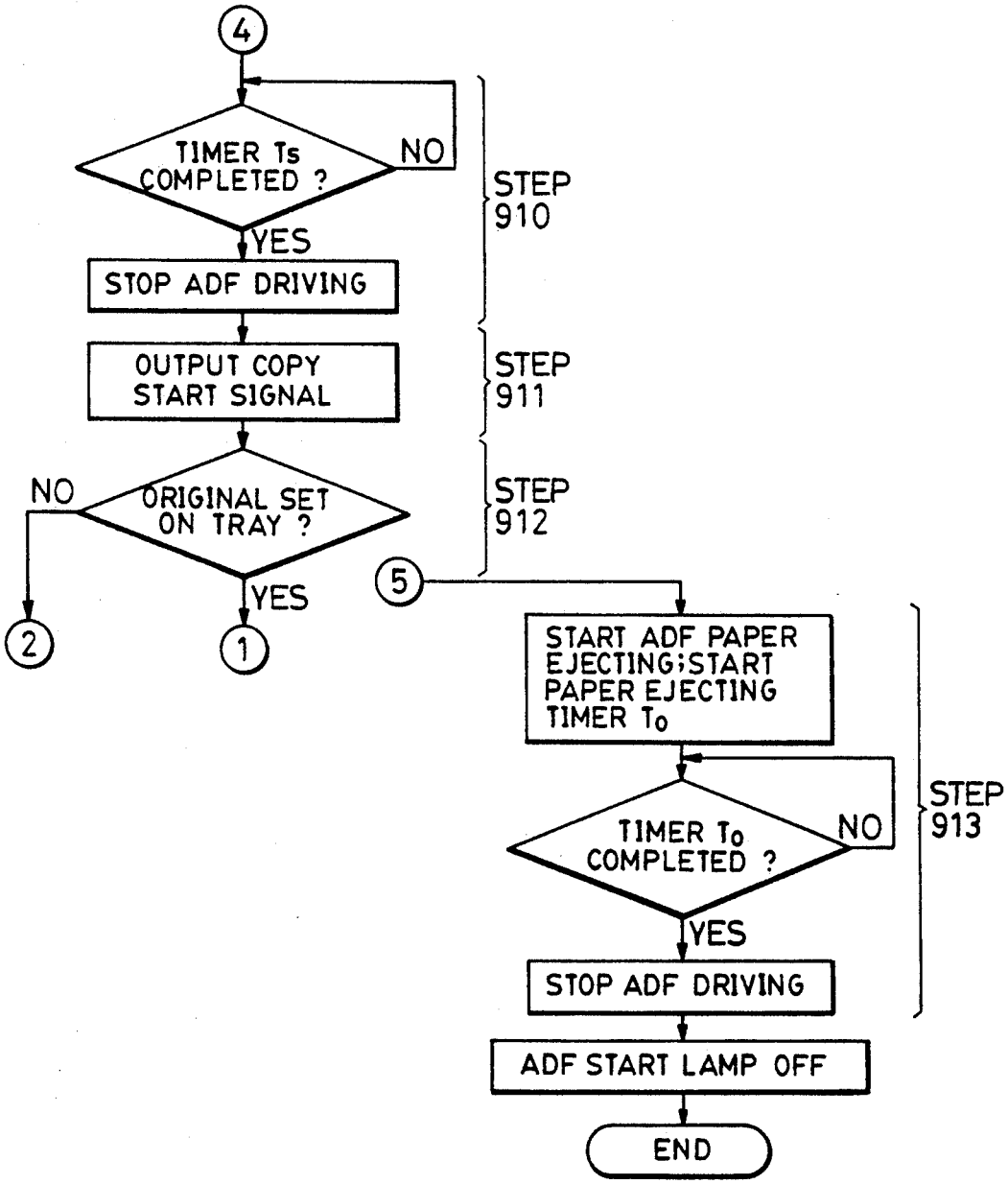

Referring to FIG. 9A, in step 901, the operator sets an original or originals on the original tray 4 of the ADF, and pushes the ADF start switch at the panel so as to turn on the ADF start switch and to energize the ADF. In step 902, the lowermost original is separated from the remaining originals. The original is supplied inside the ADF and is stopped when the leaking end of the original is detected by the ADF original sensor. In this state, if the ADF start signal is set or enabled, the copy start signal is reset so as to prohibit the copying operation of the copying machine and the AE reset signal is turned on (step 903). If it is determined in step 904 that the ADF original sensor detects the original, the flow advances to step 905 to start ADF paper or original feeding. However, if it is determined in step 904 that ADF original sensor does not detect the original, the flow advances to step 913 to be described later to perform ADF paper ejection. In step 905, the drive motor and the clutch are turned on to start feeding the paper or original. In step 904, it is checked if the leading end of the original is detected by the entrance sensor 20. When it is determined in step 906 that the entrance sensor 20 detects the leading end of the original, an original stop counter TS is started. The counter TS counts up pulses from a clock generator (not shown).

In order to perform the AE measurement, the AE measurement circuit shown in FIG. 7 is operated. In step 906, the AE reset signal which was turned on in step 904 is turned off so as to prepare for the AE measurement. In step 907, the AE measurement signal is turned on to enable the AE measurement circuit.

In order to scan the entire surface of the original, when the rear end of the original is detected by the entrance sensor 20, the AE measurement signal is turned off to complete the AE measurement in step 908. After the count of the original stop counter TS reaches a predetermined value, the drive motor and the clutch are turned off so as to stop the original at a predetermined position (exposure position) on the original glass plate 3 (step 910). The copy start signal is supplied from the ADF to the copying machine, and the copying machine starts the copying operation of a predetermined number of sheets (step 911).

It is then checked if the next original is set on the original tray 4. If there is another original waiting to be copied, the flow returns to step 902 and the ADF starts the operation. However, if there are no more originals, the flow returns to step 903. When the copying operation of a predetermined number of sheets is completed and the ADF start signal is supplied from the copying machine to the ADF, the flow advances to step 904. In step 904, since the ADF original sensor does not detect the original, the flow advances to step 913, as has been descried above.

In step 913, in order to eject the original at the exposure operation, the drive motor and the clutch are turned on so as to start a paper ejecting timer T0, thereby ejecting the original. When the preset time of the ejecting timer T0 is up, the drive motor and the clutch are turned off, the ADF start lamp is turned off, and the flow returns to the start of the sequence. When there is a next original waiting to be copied, the current original is ejected while the next original is fed and is subjected to AE measurement.

What is claimed is:

1. An original image reading device comprising:

an original mount;

feed means for separating and feeding originals on said original mount;

a first feed path for guiding each of the separated and fed originals to a reading position;

a second feed path having an inlet for receiving each of the originals discharged from said reading position and having a joining portion for joining said first feed path, said second feed path for guiding the original introduced from said inlet to said joining portion and said second feed path for reversing a first surface to a second surface of the original;

a third feed path for returning the originals of which image reading is completed, onto said original mount; and original density detection means provided between said joining portion and said reading position in said first feed path for detecting both sides of each of the originals in one guide operation by said first feed path, wherein, when the originals are guided by said second feed path to said reading position, image reading is performed in accordance with the density information detected by said original density detection means during the one guide operation.

2. An original image reading device according to claim 1, wherein said density detection means operates during a period of time when a leading end of the original has been detected until a trailing end of the original passes said detection means.

3. An original image reading device according to claim 1, wherein the density detection means detects a trailing end of the original, operates a timer when the trailing end of the original passes said density detection means, and stops the original at the reading position.

4. An original image reading device according to claim 3, further comprising feed rollers disposed between said joining portion and said density detection means.

5. An original image reading device comprising:

an original mount;

feed means for separating and feeding originals on said original mount;

a first feed path for guiding each of the separated and fed originals to a reading position;

a second feed path having an inlet for receiving each of the originals discharged from said reading position and having a joining portion for joining said first feed path, said second feed path for guiding the original introduced from said inlet to said joining portion and said second feed path for reversing a first surface to a second surface of the original; and original density detection means provided between said joining portion and said reading position in said first feed path, wherein said density detection means comprises first and second density detectors, wherein said first density detector is disposed so as to detect a first density of the first surface of the original in the first feed path, wherein said second density detector is disposed so as to detect a second density of a second surface of the original, and wherein the second density is stored in a memory.

6. An image forming apparatus comprising:

an original mount;

feed means for separating and feeding originals on said original mount;

a first feed path for guiding each of the separated and fed originals to a reading position;

a second feed path having an inlet for receiving each of the originals discharged from said reading position and having a joining portion for joining said first feed path, said second feed path for guiding the original introduced from said inlet to said joining portion and said second feed path for reversing a first surface to a second surface of the original;

a third feed path for returning the originals of which image reading is completed, onto said original mount;

original density detection means provided between said joining portion and said reading position in said first feed path for detecting both sides of each of the originals in one guide operation by said first feed path;

an original reading light source, wherein an amount of light of said light source is changed in accordance with the density information from said density detection means; and image forming means for forming an original image read by said light source on a sheet material, wherein, when the originals are guided by said second feed path to said reading position, image forming is performed in accordance with the density information detected by said original density detection means during the one guide operation.

7. An image forming apparatus according to claim 6, wherein said density detection means operates during a period of time when a leading end of the original has been detected until a trailing end of the original passes said detection means.

8. An image forming apparatus according to claim 6, wherein said density detection means detects a trailing end of the original, operates a timer when the trailing end of the original has passed said density detection means, and stops the original at the reading position.

9. An image forming apparatus according to claim 8, further comprising feed rollers disposed between said joining portion and said density detection means.

10. An image forming apparatus according to claim 6, wherein said density detection means comprises first and second density detectors, wherein said first density detector is disposed so as to detect a first density of the first surface of the original in the first feed path, wherein said second density detector is disposed so as to detect the second density of a second surface of the original, and wherein the second density is stored in a memory.

11. An original image reading device comprising:

an original mount;

feed means for separating and feeding originals on said original mount;

a feed path for guiding each of the separated and fed originals to a reading position;

a return path for returning originals of which image reading is completed, onto said original mount; and original density detection means provided between said feed means and said reading position in said feed path for detecting both sides of each of the originals in one guide operation by said feed path, wherein, when the originals are guided by said feed path plural times, image reading is performed in accordance with density information detected by said original density detection means during the one guide operation.

12. An image forming apparatus comprising:

an original mount;

feed means for separating and feeding originals on said original mount;

a feed path for guiding each of the separated and fed originals to a reading position;

a return path for returning originals of which image reading is competed, onto said original mount;

original density detection means provided between said feed means and said reading position on said feed path for detecting both sides of each of the originals in one guide operation by said feed path;

an original reading light source, wherein an amount of light of said light source is changed in accordance with the density information from said density detection means; and image forming means for forming an original image read by said light source on a sheet material, wherein when the originals are guided by said feed path plural times, image forming is performed in accordance with the density information detected by said original density detection means during the one guide operation by said feed path.

13. An image forming apparatus comprising:

an original mount;

feed means for separating and feeding originals on said original mount;

a first feed path for guiding each of the separated and fed originals to a reading position;

a second feed path having an inlet for receiving each of the originals discharged from said reading position and having a joining portion for joining said first feed path, said second feed path for guiding the original introduced from said inlet to said joining portion and said second feed path for reversing a first surface to a second surface of the original;

original density detection means provided between said joining portion and said reading position in said first feed path, wherein said density detection means comprises first and second density detectors, wherein said first density detector is disposed so as to detect a first density of the first surface of the original in the first feed path, wherein said second density detector is disposed so as to detect a second density of a second surface of the original, and wherein the second density is stored in a memory;

an original reading light source, wherein an amount of said light source is changed in accordance with the density information from said density detection means; and image forming means for forming an original image read by said light source on a sheet material;

wherein, when the originals are guided by said second feed path to said reading position, image forming is performed in accordance with the density information detected by said original density detection means during the one guide operation.

14. An original image reading device comprising:

an original mount;

feed means for separating and feeding originals on sid original mount;

a feed path for guiding each of the separated and fed originals to a reading position;

a return path for returning originals of which image reading is completed, onto said original mount; and original density detection means provided between said feed means and said reading position in said feed path;

wherein when originals are guided by said feed path plural times, and image reading is performed plural times, a density of the original is detected at a first guide operation and is stored, and image reading is performed in accordance with said stored density information.

15. An original image reading device according to claim 14 further comprising:

a second feed path having an inlet for receiving each of the original discharged from said reading position and having a joining portion for joining said first feed path, said second feed path for guiding the original introduced from said inlet to said joining portion and said second feed path for reversing a first surface to a second surface of the original;

wherein said density detection means comprises a density detector disposed at one side in the first feed path, and wherein said density detector detects the first surface and the second surface of the original.

16. An image forming apparatus comprising:

an original mount;

feed means for separating and feeding originals on said original mount;

a feed path for guiding each of the separated and fed originals to a reading position;

a return path for returning originals of which image reading is completed, onto said original mount;

original density detection means provided between said feed means and said reading position in said feed path;

an original reading light source, wherein an amount of light of said light source is changed in accordance with the density information from said density detection means; and image forming means for forming an original image read by said light source on a sheet material, wherein when originals are guided bay said feed path plural times, and image reading is performed plural times, a density of the original is detected at a first guide operation and is stored, and image forming is performed in accordance with said stored density information.

17. An image forming apparatus according to claim 16 further comprising:

a second feed path having an inlet for receiving each of the originals discharged from said reading position and having a joining portion for joining said first feed path, said second feed path for guiding the original introduced from said inlet to said joining portion and said second feed path for reversing a first surface to a second surface of the original;

wherein said density detection means comprises a density detector disposed at one side in the first feed path, and wherein said density detector detects the first surface and the second surface of the original.

* * * * *

UNITED STATES PATENT AND TRADEMARK OFFICE

CERTIFICATE OF CORRECTION

PATENT NO. : 5,229,816

DATED : JULY 20, 1993

INVENTOR(S) : HITOSHI FUJIMOTO, ET AL.

It is certified that error appears in the above-indentified patent and that said Letters Patent is hereby corrected as shown below:

COLUMN 3

Line 61, "detemination" should read --determination--.

COLUMN 5

Line 67, "that" should read --that the--.

COLUMN 6

Line 4, "step 904," should read --step 906,--.

Line 38, "descried" should read --described--.

COLUMN 8

Line 58, "competed," should read --completed,--.

COLUMN 9

Line 1, "wherein" should read --wherein,--.

Line 42, "sid" should read --said--.

Line 51, "wherein" should read --wherein,--.

COLUMN 10

Line 4, "claim 14" should read --claim 14,--.

Line 34, "wherein" should read --wherein,--; and "bay" should read --by--.

UNITED STATES PATENT AND TRADEMARK OFFICE

CERTIFICATE OF CORRECTION

PATENT NO. : 5,229,816 Page 2 of 2

DATED : July 20, 1993

INVENTOR(S) : Hitoshi Fujimoto, et al

It is certified that error appears in the above-indentified patent and that said Letters Patent is hereby corrected as shown below:

Column 10, line 41, "16" should read --16,--

Signed and Sealed this

Twelfth Day of April, 1994

Bruce Lehman

*Attest:*

BRUCE LEHMAN

*Commissioner of Patents and Trademarks*

*Attesting Officer*